US009162369B2

(12) United States Patent
Verville et al.

(10) Patent No.: US 9,162,369 B2
(45) Date of Patent: Oct. 20, 2015

(54) EMBOSSED MONOLAYER PARTICLEBOARDS AND METHODS OF PREPARATION THEREOF

(76) Inventors: Andre Verville, Laval (CA); Ekkehard Brommer, Nuremberg (DE); Claude Fortin, Sayabec (CA); Richard Lepine, Québec (CA)

( * ) Notice: Subject to any disclaimer, the term of this patent is extended or adjusted under 35 U.S.C. 154(b) by 847 days.

(21) Appl. No.: 12/582,650

(22) Filed: Oct. 20, 2009

(65) Prior Publication Data

US 2010/0104813 A1 Apr. 29, 2010

Related U.S. Application Data

(60) Provisional application No. 61/136,999, filed on Oct. 21, 2008.

(51) Int. Cl.

| | |
|---|---|
| ***B27N 3/06*** | (2006.01) |
| ***B27N 3/14*** | (2006.01) |
| ***B27N 3/18*** | (2006.01) |

(52) U.S. Cl.

CPC .. *B27N 3/06* (2013.01); *B27N 3/14* (2013.01); *B27N 3/18* (2013.01); *Y10T 428/24479* (2015.01)

(58) Field of Classification Search

CPC ..... B27N 3/06
USPC ..... 264/319
See application file for complete search history.

(56) References Cited

U.S. PATENT DOCUMENTS

| | | | | |
|---|---|---|---|---|
| 3,983,307 | A | 9/1976 | Power et al. | |
| 4,004,767 | A | 1/1977 | Chilton | |
| 4,007,076 | A | 2/1977 | Clarke et al. | |
| 4,112,169 | A | 9/1978 | Huffman et al. | |
| 4,236,365 | A * | 12/1980 | Wheeler | 52/455 |
| 4,955,169 | A | 9/1990 | Shisko | |
| 5,000,673 | A | 3/1991 | Bach et al. | |
| 5,008,057 | A | 4/1991 | Risius et al. | |
| 5,016,416 | A | 5/1991 | Munk | |
| 5,045,262 | A | 9/1991 | Munk | |
| 5,170,603 | A | 12/1992 | Barlett | |
| 5,213,821 | A | 5/1993 | Munk | |
| 5,217,665 | A | 6/1993 | Lim et al. | |
| 5,275,682 | A | 1/1994 | Götz | |
| 5,290,621 | A | 3/1994 | Bach et al. | |
| 5,344,704 | A | 9/1994 | O'Dell et al. | |
| 5,391,340 | A | 2/1995 | Mirous et al. | |
| 5,647,934 | A | 7/1997 | Vaders et al. | |
| 5,695,875 | A | 12/1997 | Larsson et al. | |
| 5,744,079 | A | 4/1998 | Kimura et al. | |
| 5,869,138 | A | 2/1999 | Nishibori et al. | |
| 5,908,496 | A | 6/1999 | Singule et al. | |
| 5,980,798 | A | 11/1999 | Bonomo et al. | |
| 5,989,468 | A | 11/1999 | Lundgren et al. | |
| 5,993,709 | A | 11/1999 | Bonomo et al. | |
| 6,007,320 | A | 12/1999 | Froese et al. | |
| 6,113,729 | A | 9/2000 | Chiu | |
| 6,132,503 | A | 10/2000 | Singule et al. | |
| 6,132,656 | A | 10/2000 | Dodd | |
| 6,187,234 | B1 | 2/2001 | Bonomo et al. | |
| 6,197,235 | B1 | 3/2001 | Miller et al. | |
| 6,312,632 | B1 | 11/2001 | Graf | |
| 6,344,101 | B1 | 2/2002 | Graf | |
| 6,364,982 | B1 | 4/2002 | Lynch et al. | |
| 6,479,128 | B1 | 11/2002 | Schafernak et al. | |
| 6,541,097 | B2 | 4/2003 | Lynch et al. | |
| 6,569,540 | B1 | 5/2003 | Preston et al. | |
| 6,579,483 | B1 | 6/2003 | Vaders | |
| 6,605,245 | B1 | 8/2003 | Dubelsten et al. | |
| 6,638,459 | B2 | 10/2003 | Mente et al. | |
| 6,649,098 | B2 | 11/2003 | Mente et al. | |
| 6,696,167 | B2 | 2/2004 | Sean et al. | |
| 6,743,318 | B2 | 6/2004 | Vaders | |
| 6,841,231 | B1 | 1/2005 | Liang et al. | |
| 6,866,740 | B2 | 3/2005 | Vaders | |
| 6,881,771 | B2 | 4/2005 | Haas et al. | |
| 6,923,999 | B2 | 8/2005 | Graf | |
| 6,972,150 | B2 | 12/2005 | Vaders | |
| 7,077,988 | B2 | 7/2006 | Gosselin | |
| 7,096,916 | B2 | 8/2006 | Vaders | |
| 7,108,031 | B1 | 9/2006 | Secrest | |
| 7,314,585 | B2 | 1/2008 | Vaders | |
| 7,393,480 | B2 | 7/2008 | Haas | |
| 2001/0032432 | A1 | 10/2001 | Paxton et al. | |
| 2004/0086678 | A1 | 5/2004 | Chen et al. | |
| 2006/0264519 | A1 | 11/2006 | Eckert et al. | |
| 2007/0175041 | A1 | 8/2007 | Hardwick et al. | |
| 2007/0207296 | A1 | 9/2007 | Eisermann | |
| 2010/0247943 | A1 | 9/2010 | Demeyere et al. | |

(Continued)

FOREIGN PATENT DOCUMENTS

| | | |
|---|---|---|
| CA | 1319883 | 10/1985 |
| CA | 2004182 | 5/1990 |
| CA | 2036584 | 8/1991 |
| CA | 2049396 | 2/1992 |
| CA | 2049397 | 2/1992 |
| CA | 1301618 | 5/1992 |
| CA | 2057476 | 6/1992 |
| CA | 1310801 | 12/1992 |
| CA | 2085175 | 6/1993 |

(Continued)

OTHER PUBLICATIONS

From Wikipedia, the free encyclopedia, "Particle board" [online], [retrieved on Aug. 10, 2012]. Retrieved from the Internet <URL: http://en.wikipedia.org/wiki/Particle_board>.

(Continued)

*Primary Examiner* — Larry Thrower

(57) ABSTRACT

There is provided an embossed particleboard, which can be used, for example, as a siding. The particleboard comprises a monolayer embossed particleboard including wood particles having an average size of less than 4 mm, a resin, and optionally a sizing agent. There is also provided a method of manufacturing a wood-based product such as a siding. The method comprises embossing and pressing in a single step a monolayer mat comprising wood particles having an average size of less than 4 mm and a resin, so as to obtain an embossed monolayer particleboard siding.

21 Claims, No Drawings

(56) References Cited

U.S. PATENT DOCUMENTS

| | | | |
|---|---|---|---|
| 2010/0310838 | A1 | 12/2010 | Ketzer et al. |
| 2010/0326583 | A1 | 12/2010 | Korai |
| 2011/0014414 | A1 | 1/2011 | Senior |
| 2011/0052905 | A1 | 3/2011 | Smith |
| 2011/0104431 | A1 | 5/2011 | Niedermaier |
| 2011/0104483 | A1 | 5/2011 | Shinozaki et al. |
| 2011/0117340 | A1 | 5/2011 | Oldorff |
| 2011/0139356 | A1 | 6/2011 | Pohe |
| 2011/0167744 | A1 | 7/2011 | Whispell et al. |
| 2011/0175251 | A1 | 7/2011 | Ziegler et al. |
| 2011/0177319 | A1 | 7/2011 | Ziegler et al. |
| 2011/0189448 | A1 | 8/2011 | Lindgren et al. |
| 2011/0217463 | A1 | 9/2011 | Oldorff |
| 2011/0217562 | A1 | 9/2011 | Peretolchin et al. |
| 2011/0220271 | A1 | 9/2011 | Fyie et al. |
| 2011/0223411 | A1 | 9/2011 | Pfau et al. |

FOREIGN PATENT DOCUMENTS

| | | | |
|---|---|---|---|
| CA | 2117529 | | 9/1993 |
| CA | 2138546 | | 1/1994 |
| CA | 1329872 | | 5/1994 |
| CA | 2102959 | | 8/1994 |
| CA | 2186264 | | 12/1995 |
| CA | 2244005 | | 2/1997 |
| CA | 2197696 | | 8/1997 |
| CA | 2245946 | | 8/1997 |
| CA | 2250161 | | 8/1997 |
| CA | 2255894 | | 1/1998 |
| CA | 2199463 | | 3/1998 |
| CA | 2279852 | | 7/1998 |
| CA | 2255784 | | 10/1998 |
| CA | 2236633 | | 11/1998 |
| CA | 2210125 | | 1/1999 |
| CA | 2315008 | | 6/1999 |
| CA | 2266246 | | 9/1999 |
| CA | 2335204 | | 12/1999 |
| CA | 2336649 | | 1/2000 |
| CA | 2279808 | | 2/2000 |
| CA | 2344041 | | 3/2000 |
| CA | 2350526 | | 5/2000 |
| CA | 2356893 | | 8/2000 |
| CA | 2368091 | | 11/2000 |
| CA | 2317281 | | 2/2001 |
| CA | 2402003 | | 9/2001 |
| CA | 2405674 | | 10/2001 |
| CA | 2406170 | | 10/2001 |
| CA | 2421037 | | 2/2002 |
| CA | 2368328 | | 7/2002 |
| CA | 2400836 | | 2/2003 |
| CA | 2484852 | | 11/2003 |
| CA | 2431292 | | 12/2003 |
| CA | 2432881 | | 12/2003 |
| CA | 2503553 | | 5/2004 |
| CA | 2545008 | | 5/2005 |
| CA | 2519489 | | 9/2005 |
| CA | 2508148 | | 11/2005 |
| CN | 102069523 | | 5/2011 |
| EP | 2305462 | | 4/2011 |
| EP | 2308678 | | 4/2011 |
| EP | 2319688 | | 5/2011 |
| GB | 939863 | | 10/1963 |
| GB | 965108 | | 7/1964 |
| GB | 1443194 | | 7/1976 |
| JP | 2002086421 | | 3/2002 |
| JP | 2010280152 | | 12/2010 |
| KR | 2011062424 | | 6/2011 |
| WO | 9928102 | | 6/1999 |
| WO | 9967069 | | 12/1999 |
| WO | WO 2007/061201 | * | 5/2007 |
| WO | 2009141743 | | 11/2009 |
| WO | 2010055429 | | 5/2010 |
| WO | 2011077518 | | 6/2011 |
| WO | 2011082491 | | 7/2011 |

OTHER PUBLICATIONS

Berglung et al., Handbook of Wood Chemistry and Wood Composites, 2005, p. 279-301.

English Abstract of DE 19956765(A1), Nickel, E., May 31, 2000.

* cited by examiner

EMBOSSED MONOLAYER PARTICLEBOARDS AND METHODS OF PREPARATION THEREOF

CROSS-REFERENCE TO RELATED APPLICATION

This application claims the benefit of U.S. provisional application No. 61/136,999 filed on Oct. 21, 2008 which is hereby incorporated by reference in its entirety.

FIELD OF THE DISCLOSURE

The present disclosure relates to the field of transformed wood-based materials. More specifically, the disclosure relates to embossed monolayer particleboards that can be used as siding.

BACKGROUND OF THE DISCLOSURE

Siding such as exterior siding of a building can be made of various materials. Many siding products encountered on the market are wood-based products. Such wood-based products include High Density Fiberboard (HDF) siding, Medium Density Fiberboard (MDF) siding, hardboard siding (Canaxel™) and Oriented Strand Board (OSB) siding. In order to provide these products with an interesting look such as a look that imitates natural wood, some manufacturers decided to emboss the siding so as to provide a wood grain embossing pattern to the siding.

However, the technologies that are available in order to prepare such products comprise important drawbacks. In a general manner, such products are prepared by using processes that comprise several steps and that are quite complicated. This also explains the relatively high price of the embossed siding.

Embossed MDF or HDF siding has interesting mechanical properties and it can be easily machined but its production costs are quite high since fibers must be refined.

It would thus be desirable to be provided with an alternative to the existing siding.

SUMMARY OF THE DISCLOSURE

In accordance with one aspect there is provided an embossed particleboard. The particleboard comprises a monolayer embossed particleboard including wood particles having an average size of less than about 4 mm, a resin, and optionally a sizing agent. Such a particleboard can be used for preparing various transformed wood-based materials such as siding, flooring material, outdoor furniture, outside moulding, road and commercial signs, and fencing etc.

In accordance with another aspect, there is provided an embossed particleboard. The particleboard is a monolayer embossed particleboard comprising wood particles having an average size of less than about 4 mm, a resin, and optionally a sizing agent.

In accordance with another aspect there is provided a method of manufacturing a wood-based siding. The method comprises embossing and pressing in a single step a monolayer mat comprising wood particles having an average size of less than about 4 mm and a resin, so as to obtain an embossed monolayer particleboard siding.

In accordance with another aspect there is provided a method of manufacturing a wood-based siding comprising:

obtaining wood particles having an average thickness of less than about 1 mm, an average length of less than about 40 mm, an average width of less than about 15 mm, and a moisture content of less than about 5%;

screening the wood particles through a 2 mm×2 mm square mesh so as to obtain screened wood particles;

mixing the screened wood particles with a resin and optionally with a sizing agent so as to obtain a mixture;

forming a monolayer mat with the mixture;

prepressing the monolayer mat so as to at least partially remove air therefrom; and embossing and pressing under heat and pressure, in a single step, the monolayer mat so as to obtain an embossed monolayer particleboard siding.

In accordance with another aspect there is provided a method of manufacturing a wood-based siding comprising:

obtaining wood particles having an average thickness of less than about 1 mm, an average length of less than about 40 mm, an average width of less than about 15 mm, and a moisture content of less than about 5%;

screening the wood particles through a 2 mm×2 mm square mesh so as to obtain screened wood particles;

mixing the screened wood particles with a resin and optionally with a sizing agent so as to obtain a mixture;

forming a monolayer mat with the mixture by distributing the wood particles in the mat in such a manner that the smaller wood particles are mainly present at surfaces of the board and that larger particles are mainly present in a central portion of the board;

prepressing the monolayer mat so as to at least partially remove air therefrom; and embossing and pressing under heat and pressure, in a single step, the monolayer mat so as to obtain an embossed monolayer particleboard siding.

In accordance with another aspect there is provided a method of manufacturing a wood-based siding comprising:

obtaining wood particles having an average thickness of less than about 0.8 mm, an average length of less than about 30 mm, an average width of less than about 10 mm, and a moisture content of less than about 5%;

screening the wood particles through a 2 mm×2 mm square mesh so as to obtain screened wood particles;

mixing the screened wood particles with a resin and optionally with a sizing agent so as to obtain a mixture having a resin content of about 1% to about 15% by weight based on the dry wood particles weight, and a sizing agent content of about 0% to about 5% by weight based on the dry wood particles weight;

forming a monolayer mat with the mixture;

prepressing the monolayer mat so as to at least partially remove air therefrom; and embossing and pressing under heat and pressure, in a single step, the monolayer mat so as to obtain an embossed monolayer particleboard siding.

It has been found that such methods allow for the production of a resistant siding at a low cost. It was also found that such a methods allow for the manufacture of siding that is suitable for use as exterior siding and that meet the standards of the industry (for example the CGSB 11.3 (87) standard). Such methods are particularly interesting since they are simple and they involve a limited number of steps since embossing and pressing can be carried out simultaneously using the same press. Moreover, since the wood particles used can be non-refined wood particles, the production costs are considerably lowered. Such a unique particleboard siding is also quite interesting in view of the fact that it includes only one layer of wood particles, that renders it more simple.

DETAILED DESCRIPTION OF THE DISCLOSURE

The following examples are presented in a non-limitative manner.

The expression "wood particles having an average size of less than about 4 mm" as used herein refers, for example, to wood particles that have been passed through a 4 mm×4 mm square mesh. For example, such wood particles can have an average length that is less than about 4 mm.

The expression "wood particles having an average size of less than about 2 mm" as used herein refers, for example, to wood particles that have been passed through a 2 mm×2 mm square mesh. For example, such wood particles can have an average length that is less than about 2 mm.

The expression "consisting essentially of" as used herein when referring to the particleboard means that such a particleboard can also comprise various components that do not materially affect or modify the mechanical and physical properties of the particleboard. Such components can be paint, protective layer(s), sealer, sizing agent, etc. Such components can also be, any components known to the person skilled in the art that when added in a certain quantity will not materially affect or modify the mechanical and physical properties of the particleboard.

The term "about" is intended to mean a reasonable amount of deviation of the modified term or expression such that the end result is not significantly changed. These terms of degree should be construed as including a deviation of at least ±5% of the modified term or expression if this deviation would not negate the meaning of the term or expression it modifies.

In the methods and particleboards disclosed in the present document, the mat can further comprise a sizing agent such as a wax. For example, the mat or board can comprise about 0.5% to about 7%, or about 1% to about 5% of wax by weight based on the dry wood particles weight. The mat or board can comprise about 0.5% to about 20%, about 0.9% to about 17%, about 1% to about 15%, about 8% to 20%, about 9 to 20% or about 10 to 15% of the resin by weight based on the dry wood particles weight. For example, the wood particles can be non-refined wood particles and they can exclude the presence of refined fibers. The wood particles can comprise saw dust, wood chips, wood flakes, wood flour, wood shavings, unrefined fibers, ground wood particles, cut wood particles, wood particles obtained from a dry process, or mixtures thereof. The particleboard can comprise a wood grain embossing pattern on at least one surface thereof. The particleboard can comprise a wood grain embossing pattern having an average relief depth of less than about 10 mm, less than about 5 mm, or less than about 3 mm, on at least one surface thereof. It can also be possible to provide a similar particleboard which is not embossed. The particleboard can have a bending strength of about 10 MPa to about 30 MPa, about 13 MPa to about 27 MPa, or about 20 MPa to about 25 MPa. The particleboard can have a bending strength of at least about 13, 14, 15, 16, 17, 18, 19, 20, 21, 22, or 23 MPa. The particleboard can have an internal bond strength of about 0.2 to about 1.5 MPa, about 0.5 MPa to about 1.3 MPa, about 0.6 MPa to about 0.9 MPa, about 0.2 to about 0.8 MPa or about 0.4. to about 0.8 MPa. The particleboard can have an internal bond strength of at least about 0.2, 0.3, 0.4, 0.5, 0.6 or 0.7 MPa. The particleboard can have a density of about 500 kg/m$^3$ to about 1000 kg/m$^3$, of about 650 kg/m$^3$ to about 950 kg/m$^3$ or about 700 kg/m$^3$ to about 900 kg/m$^3$. The particleboard can have a thickness swelling of about 1% to about 4% about 2% to about 8% or about 3% to about 6%. The particleboard can have a thickness swelling of less than about 4, 3, 2.5 or 2%. The particleboard can have a hardness of at least about 2600, 2700, 2800, 2900, 3000, 3100 or 3200 N. The particleboard can have a hardness of about 2800 to about 4000 N or about 2800 to about 3800 N. The particleboard can have a lateral nail resistance of at least about 750, 850, 950, 1050 or 1150 N. The particleboard can have a lateral nail resistance of about 800 to about 1500 N, about 900 to about 1450 N, or about 1150 to about 1450 N. The particleboard can have an impact resistance of at least about 1000 mm, 1300 mm or 1600 mm. For example, the particleboard can be one that meets the requirements of the CGSB 11.3 (87) standard for a type 5 panel for an exterior wall application.

In the methods and particleboards disclosed in the present document, the average size of the wood particles can be, for example, less than about 3 mm, less than about 2 mm, about 0.1 mm to about 2 mm, about 0.3 mm to about 0.7 mm, or about 0.4 mm to about 0.6 mm. For example, the average length of the wood particles can be less than about 3 mm, less than about 2 mm, about 0.1 mm to about 2 mm, about 0.3 mm to about 0.7 mm, or about 0.4 mm to about 0.6 mm. The wood particles in the particleboard can be distributed in such a manner that the smaller wood particles are mainly present at surfaces of the board and that larger particles are mainly present in a central portion of the board.

In the methods disclosed in the present document, embossing and pressing can be carried out simultaneously in a steel belt press, a single opening press or a multiopenings press. The press can be adapted to emboss the mat on at least one surface thereof. For example, the press can be adapted to emboss only the upper or lower surface or it can be adapted to emboss both of them. The mat can be pressed at a temperature of about 150° C. to about 300° C., about 160° C. to about 250° C., or about 170° C. to about 240° C. Before the embossing and pressing, the mat can be treated so as to at least partially remove air inside the mat. For example, the mat can be formed by distributing the wood particles in the mat in such a manner that the smaller particles are mainly present at surfaces of the mat and that larger particles are mainly present in a central portion of the mat. Such a distribution can be made by using wind and/or mechanical power. Before mixing the resin with the wood particles so as to form the mat, the wood particles can be at least partially dried. For example, before mixing the resin with the wood particles so as to form the mat, the wood particles can be heat dried at a temperature of about 100° C. to about 275° C. until the wood particles have a moisture content of less than about 5% or of about 125° C. to about 250° C. until the wood particles have a moisture content of less than about 3%.

In the methods disclosed in the present document, before being dried, the wood particles can be grinded or chipped by means of a flaking machine, a knife ring flakers, or a hammermill machine so as to obtain particles having an average thickness of less than about 0.8 mm, an average length of less than about 30 mm and an average width less than about 10 mm. The methods of the present document can further comprise cooling the particleboard and piling it on at least one another particleboard The methods can also further comprise cooling the particleboard at a temperature of about 60° C. to about 120° C. The methods can further comprise cutting and/or milling the so-obtained particleboard. The methods can further comprise cutting the particleboard to a desired size. The methods can further comprise applying at least one protective layer (for example a waterproof layer) on at least one surface of the particleboard. The methods can further comprise applying at least one layer of paint on at least one surface of the particleboard. The methods can also comprise applying a prepress sealer. For example, such a prepress sealer can be applied before embossing and pressing the mat under heat and pressure.

The particleboard can exclude the presence of a printed pattern.

Production Process of an Embossed Monolayer Particleboard Siding

For example, an embossed monolayer particleboard for use as a siding can be made as follows:

1—Raw Material Handling a. The raw material used can be, for example, a mix of spruce, pine, fir, maple, birch, aspen and other types of wood obtained from different sawmills or wood transformation facilities around Sayabec, Quebec, Canada. The size of the wood obtained depends on the supplier—a supplier may send anything from logs to chips, shavings or sawdust, etc.

b. The bigger pieces of wood can be grinded or chipped using wood flaking machine or knife ring flakers to make particles having a thickness of less than about 0.8 mm, a length of less than about 30 mm and a width of less than about 10 mm.

2—Drying Operation a. The wood particles can then be dried in a heated dryer at a temperature of about 150° C. to about 230° C. to remove the water and to bring the moisture content of the wood about 1% to about 3% based on dry weight in a rotating cylinder drying unit.

3—Screening Operation a. The dry material can then be screened. For the siding production, only particles passing through a screen with 2 mm square mesh or other configuration in view to reach an average size of 2 mm are kept. The bigger particles can be sent to a wood grinding machine to be reduced to have a width and thickness both less than about 2 mm.

4—Resin Blending and Wax Addition a. The particles can then be sent to a blending unit where the resin and the wax is mixed in with the wood. For siding products, a phenol-formaldehyde adhesive that is graded for exterior application can be used. Various other resins suitable for exterior applications can also be useda. Resin loading tests have been done by using about 10% to about 15% based on the dry wood weight and wax of about 0% to about 5%.

5—Mat Forming a. The resinated particles can then be assembled together in a forming machine to create the wood mat or the wood cake. The forming can be done by distributing the small particles on the faces and to gradually have the bigger pieces in the middle of the mat. Such a distribution can be made by using wind and/or mechanical power.

6—Prepressing Operation a. A prepressing operation can be made so as to allow for removal of part of the air inside the mat and to give better compaction before entering the press.

b. A prepress sealer (for example a chemical sealer such as F-610-002' from Akzo Nobel) can be sprayed on the mat so as to facilitate paint process of the finished board.

7—Hot Pressing a. The wood mat can then be pressed at high temperature (about 170 to about 240° C.) in an embossed single opening press until the resin is fully polymerized or cured.

8—Board Cooling and Stacking a. The boards exiting the press can then be slightly cooled down to a temperature of about 60° C. to about 120° C. and piled together.

b. The boards can then be cut to size and shipped for milling and painting process of the siding panel.

Several tests have been made in order to evaluate the various properties of the siding products described in the present document.

Evaluation of the Physical and Mechanical Properties of the Siding in Accordance with the CGSB 11.3 (87) Standard The purpose of such tests was to evaluate the physico-mechanical properties of particle panels with a nominal thickness of 12.5 mm according to the CGSB 11.3 (87) standard.

Procedure and Results

The results of the tests were measured using electronic equipment and thus include a certain percentage of uncertainty within the limits prescribed by the different test standards. A series of tests including bend, tensile, and dimensional stability tests, and tests for resistance to aging, resistance to tearing by nails, and impact resistance were performed according to the standards CGSB 11.3 (87) and ASTM D-1037 (06a).

Sampling of the panels was performed for the physico-mechanical evaluations. The panels were numbered 1 to 10. The panels bearing odd numbers, that is, 1, 3, 5, 7, and 9, were placed in reserve, while the five others, that is, those bearing the numbers 2, 4, 6, 8, and 10, were cut into test specimens according to the dimensions prescribed in the standard before placing them into the conditioning chamber at 20° C. and 50% relative humidity until equilibrium was attained, before proceeding with the performance measurements.

TABLE 1

Physico-Mechanical Tests Performed on the Panels

| Specifications | Number of test specimens per panel | Dimensions (mm) |
|---|---|---|
| Swelling | 4 | 150 × 150 |
| Linear expansion | 2 | 75 × 305 |
| Bending (normal) | 12 | 150 × 75 |
| Bending (6 cycles) | 12 | 150 × 75 |
| Resistance to aging | 12 | 150 × 75 |
| Lateral resistance to nails | 6 | 150 × 75 |
| Resistance to nailhead passage | 6 | 150 × 75 |
| Impact resistance | 6 | 229 × 254 |
| Tensile, perpendicular (Internal bond strength) | 18 | 50 × 50 |
| Tensile, parallel | 8 | 50 × 254 |
| Hardness | 6 | 150 × 75 |

Test Results

The summaries of results for physico-mechanical performance are presented in Tables 2 to 9. The values given in parentheses indicate the coefficient of variation for each of the mean values.

In summary, the results for the collection of tests demonstrate that the panels evaluated meet the requirements of the CGSB 11.3 (87) standard for Type 5 panels used for exterior wall applications. Performance, in terms of hardness, dimensional stability, resistance to nails tearing, tensile strength, stiffness, and impact resistance, exceeds to a large extent the minimum required by the standard.

The results of accelerated aging tests (6-cycle method), which are presented in Table 6, show that the panels numbered 8 and 10 do not meet the 50% requirements for residual modulus of rupture (MOR) after the aging cycles. Panels 8 and 10 attained an average of 47% and 49%, respectively, for residual MOR, while panels 2, 4, and 6 attained averages of 65%, 51%, and 66%, respectively, for the residual MOR.

TABLE 2

Summary of Results from Hardness Tests

| Panel number | Normative value (N) | Measured value (N) | Passed? |
|---|---|---|---|
| 2 | 2600 | 2946 (12) | Yes |
| 4 | | 3579 (14) | Yes |
| 6 | | 3541 (14) | Yes |
| 8 | | 2906 (6) | Yes |
| 10 | | 3412 (16) | Yes |

*Average of 6 hardness-test specimens per panel

The values given in parentheses indicate the coefficient of variation for each of the mean values.

TABLE 3

Summary of Results from Swelling Tests

| | Swelling rate (%) (thickness swelling) | | | Absorption rate (%) | | |
|---|---|---|---|---|---|---|
| Panel number | Normative | Measured* | Passed? | Normative | Measured* | Passed? |
| 2 | 8 | 2.3 (29) | Yes | 20 | 12.6 (11) | Yes |
| 4 | | 2.3 (35) | Yes | | 11.4 (19) | Yes |
| 6 | | 2.3 (35) | Yes | | 11.5 (7) | Yes |
| 8 | | 1.6 (16) | Yes | | 12.6 (1) | Yes |
| 10 | | 1.9 (20) | Yes | | 10.9 (18) | Yes |

*Average of 4 swelling-test specimens per panel

The values given in parentheses indicate the coefficient of variation for each of the mean values.

TABLE 4

Summary of Results from Nail-Tearing Tests

| | Lateral resistance (N) | | | Head passage (N) | | |
|---|---|---|---|---|---|---|
| Panel number | Normative | Measured* | Passed? | Normative | Measured* | Passed? |
| 2 | 750 | 1404 (10) | Yes | 750 | 1263 (10) | Yes |
| 4 | | 1276 (12) | Yes | | 1211 (15) | Yes |

TABLE 4-continued

Summary of Results from Nail-Tearing Tests

| | Lateral resistance (N) | | | Head passage (N) | | |
|---|---|---|---|---|---|---|
| Panel number | Normative | Measured* | Passed? | Normative | Measured* | Passed? |
| 6 | | 1301 (8) | Yes | | 1226 (15) | Yes |
| 8 | | 1379 (15) | Yes | | 1196 (11) | Yes |
| 10 | | 1222 (21) | Yes | | 1153 (19) | Yes |

*Average of 6 lateral-resistance test specimens and 6 head-passage test specimens for each panel The values given in parentheses indicate the coefficient of variation for each of the mean values.

TABLE 5

Summary of Results from Tensile-Strength Tests

| | Perpendicular to the surface (MPa) (internal bond strength) | | | Parallel to the surface (MPa) | | |
|---|---|---|---|---|---|---|
| Panel number | Normative | Measured* | Passed? | Normative | Measured* | Passed? |
| 2 | 0.17 | 0.71 (10) | Yes | 7.0 | 9.1 (10) | Yes |
| 4 | | 0.64 (13) | Yes | | 12.5 (8) | Yes |
| 6 | | 0.75 (14) | Yes | | 11.1 (13) | Yes |
| 8 | | 0.55 (17) | Yes | | 9.1 (9) | Yes |
| 10 | | 0.62 (17) | Yes | | 12.0 (5) | Yes |

*Average of 18 perpendicular tensile-test specimens and 7 tensile-test specimens parallel to the surface The values given in parentheses indicate the coefficient of variation for each of the mean values.

TABLE 6

Summary of Results from Tests for Resistance to Aging (Bending)

| | | | | Modulus of rupture after 6-cycle treatment | | | | |
|---|---|---|---|---|---|---|---|---|
| Panel | Modulus of rupture in dry state (MPa) | | | Modulus of rupture (MPa) | | Loading (%) | | |
| number | Normative | Measured* | Passed | Normative | Measured | Normative | Calculated | Passed? |
| 2 | 13.0 | 23.0 (12) | Yes | N/A | 14.9 (22) | 50 | 65 | Yes |
| 4 | | 22.8 (30) | Yes | | 11.6 (34) | | 51 | Yes |
| 6 | | 22.7 (23) | Yes | | 15.0 (41) | | 66 | Yes |
| 8 | | 23.6 (8) | Yes | | 11.1 (13) | | 47 | No |
| 10 | | 22.7 (20) | Yes | | 11.1 (41) | | 49 | No |

*Average of 12 test specimens per panel

The values given in parentheses indicate the coefficient of variation for each of the mean values.

TABLE 7

Summary of Results from Residual Swelling after Aging Tests

| Panel number | Residual swelling (%) Normative | Measured* | Passed? |
|---|---|---|---|
| 2 | 15 | 2.90 (36) | Yes |
| 4 | | 3.94 (23) | Yes |
| 6 | | 3.53 (23) | Yes |
| 8 | | 3.34 (27) | Yes |
| 10 | | 4.31 (41) | Yes |

*Average of 12 test specimens per panel

The values given in parentheses indicate the coefficient of variation for each of the mean values.

TABLE 8

Summary of Results from Impact-Resistance Tests

| Panel number | Impact resistance (%) Normative | Measured* | Passed? |
|---|---|---|---|
| 2 | 350 | Greater than | Yes |
| 4 | | 1680 mm | Yes |
| 6 | | (maximum | Yes |
| 8 | | capability of | Yes |
| 10 | | equipment) | Yes |

*Average of 6 test specimens per panel

TABLE 9

Summary of Results from Linear-Expansion Tests, 50-90% RH

| Panel number | Linear expansion (%) Normative | Measured* | Passed? |
|---|---|---|---|
| 2 | 0.30 | 0.21 | Yes |
| 4 | | 0.18 | Yes |
| 6 | | 0.22 | Yes |
| 8 | | 0.17 | Yes |
| 10 | | 0.17 | Yes |

*Average of 2 test specimens per panel

Table 10 presents a summary of results representing the average of 5 evaluated panels. In considering the results for the collection of tests performed, it can be concludes that the panels evaluated meet all the requirements of the CGSB 11.3 (87) standard for Type 5 panels used for exterior wall applications.

TABLE 10

Summary of Test Results

| Properties evaluated | Description | Normative value | Result | CGSB 11.3-87 |
|---|---|---|---|---|
| Nail tearing | Lateral resistance to nails (N) | 750 | 1316 (14) | Passed |
| | Head passage (N) | 750 | 1210 (14) | Passed |
| Dimensional stability | Resistance to water: swelling; 24 hr in water (%) | 8.0 | 2.1 (28) | Passed |
| | Resistance to water: absorption; 24 hr in water (%) | 20.0 | 11.8 (13) | Passed |
| | Linear expansion (%), 50-90% RH | 0.30 | 0.19 (25) | Passed |

TABLE 10-continued

Summary of Test Results

| Properties evaluated | Description | Normative value | Result | CGSB 11.3-87 |
|---|---|---|---|---|
| Bending | Resistance to aging: residual swelling (%) | 15.0 | 3.6 (34) | Passed |
| | Modulus of rupture (MPa) | 13.0 | 23.0 (19) | Passed |
| | Modulus of rupture: 6 cycles (MPa) | N/A | 12.7 (35) | N/A |
| | MOR*/MOR (%) | 50 | 55 (25) | Passed |
| Tensile strength | Perpendicular (MPa) | 0.17 | 0.65 (21) | Passed |
| | Parallel (MPa) | 7.0 | 10.7 (16) | Passed |
| Hardness (N) | Textured surface | 2600 | 3384 (14) | Passed |
| | Smooth surface | | 3169 (17) | Passed |
| Impact resistance (mm) | | 350 mm | 1680 | Passed |

*MOR Modulus of rupture for test specimens subjected to six aging cycles

The values given in parentheses indicate the coefficient of variation for each of the mean values.

The values given in parentheses indicate the coefficient of variation for each of the mean values.

In general, the samples of evaluated panels demonstrated that the physico-mechanical performance meets the requirements prescribed in the CGSB 11.3 standard for Type 5 (exterior covering).

REFERENCES

ASTM D-1037-06a. Annual book of ASTM standards; Section 4: Construction, 2008. West Conshohocken, Pa.: American Society for Testing and Materials, p. 120.

CGSB 11.3, Hard-fiber panels. Publications of the Government of Canada (May 1976), Canadian General Standards Board, Gatineau, Quebec.

Therefore, as demonstrated above, the particleboard siding as described in the present document meet all the requirements of the CGSB 11.3 (87) standard related to panels (type 5) for use as exterior siding. It has thus been shown that such exterior siding can be easily prepared, at low cost, in a single step. In terms of physical and mechanical properties, the siding of the present document has the same advantages than MDF or HDF panels (very resistant and easily machined) but such a siding also has the advantages of particleboards, they can be prepared at low costs. In other words, the siding of the present document possesses the advantages of MDF or HDF panels and particleboards (as indicated above) without having their disadvantages (high cost of MDF and HDF; and low resistance of particleboard).

The present disclosure has been described with regard to specific examples. The description was intended to help the understanding of the disclosure, rather than to limit its scope. It will be apparent to one skilled in the art that various modifications may be made to the disclosure without departing from the scope of the disclosure as described herein, and such modifications are intended to be covered by the present document.

The invention claimed is:

1. A method of manufacturing a wood-based siding, comprising:

prepressing a material that consists of a monolayer mat consisting essentially of wood particles having an average size that is the same size or less than wood particles that have been pressed through a 4 mm×4 mm square mesh and a resin, the prepressing at least partially removing air therefrom; and embossing and pressing under heat and pressure in a press adapted to impart an embossing pattern to at least one surface of said siding, in a single step, the material that consists of the prepressed monolayer mat so as to obtain an embossed monolayer particleboard siding consisting essentially of said resin and wood particles and having said embossing pattern on at least one surface, wherein said wood particles exclude the presence of refined wood fibers and wherein said mat comprises about 0.5% to about 20% of the resin, based on the dry wood particles weight.

2. The method of claim 1, wherein said embossing and pressing is carried out simultaneously in a single opening press.

3. The method of claim 1, wherein said mat consists of said wood particles, said resin, and a sizing agent.

4. The method of claim 1, wherein said mat is pressed at a temperature of about 170° C. to about 240° C.

5. The method of claim 1, wherein said mat has about 0.5% to about 20% of said resin by weight based on the dry wood particles weight.

6. The method of claim 1, wherein a sizing agent is present in said mat.

7. The method of claim 1, wherein said mat is formed by distributing said wood particles in said mat in such a manner that the smaller particles are mainly present at surfaces of said mat and that larger particles are mainly present in a central portion of said mat.

8. The method of claim 1, wherein the average size of said wood particles is the same size or less than wood particles that have been passed through a 2 mm×2 mm square mesh.

9. The method of claim 1, wherein said method further comprises at least one of cutting and milling the so-obtained embossed monolayer particleboard siding, or said method further comprises applying at least one protective layer on at least one surface of said embossed monolayer particleboard siding.

10. A method of manufacturing a wood-based siding comprising:

obtaining wood particles having an average thickness of less than about 1 mm, an average length of less than about 40 mm, an average width of less than about 15 mm, and a moisture content of less than about 5%;

screening said wood particles through a 2 mm×2 mm square mesh so as to obtain screened wood particles;

mixing said screened wood particles with a resin so as to obtain a mixture;

forming a monolayer mat with said mixture by distributing said wood particles in said mat in such a manner that the smaller wood particles are mainly present at surfaces of said board and that larger particles are mainly present in a central portion of said board;

prepressing said monolayer mat so as to at least partially remove air therefrom;

applying a prepress sealer to the prepressed monolayer mat; and embossing and pressing, in a single step, in a press adapted to impart an embossing pattern to at least one surface of said siding, a material that consists of said monolayer mat so as to obtain an embossed monolayer particleboard siding consisting essentially of said resin and wood particles and having an embossing pattern on at least one surface, wherein said wood particles exclude the presence of refined wood fibers and wherein said mat comprises about 0.5% to about 20% of the resin, based on the dry wood particles weight.

11. The method of claim 1, wherein said embossing pattern is a wood grain embossing pattern.

12. The method of claim 2, wherein said embossing pattern is a wood grain embossing pattern.

13. The method of claim 10, wherein said embossing pattern is a wood grain embossing pattern.

14. The method of claim 1, wherein said embossing pattern is a wood grain embossing pattern.

15. The method of claim 10, wherein said method further comprises at least one of cutting and milling the so-obtained embossed monolayer particleboard siding, or said method further comprises applying at least one protective layer on at least one surface of said embossed monolayer particleboard siding.

16. The method of claim 1, wherein said mat comprises about 8% to about 20% of the resin, based on the dry wood particles weight.

17. The method of claim 1, wherein said mat comprises about 1% to about 15% of the resin, based on the dry wood particles weight.

18. The method of claim 1, wherein said mat comprises about 10% to about 15% of the resin, based on the dry wood particles weight.

19. The method of claim 10, wherein said mat comprises about 8% to about 20% of the resin, based on the dry wood particles weight.

20. The method of claim 10, wherein said mat comprises about 10% to about 15% of the resin, based on the dry wood particles weight.

21. The method of claim 1, further comprising before the embossing and pressing, applying a prepress sealer to the prepressed monolayer mat.

* * * * *